US006241499B1

(12) United States Patent
Stigebrandt

(10) Patent No.: US 6,241,499 B1
(45) Date of Patent: Jun. 5, 2001

(54) ROTARY PISTON ENGINE

(76) Inventor: Ake Stigebrandt, Midsommarliden 3, SE-440 30 Marstrand (SE)

( * ) Notice: Subject to any disclaimer, the term of this patent is extended or adjusted under 35 U.S.C. 154(b) by 0 days.

(21) Appl. No.: 09/381,007

(22) PCT Filed: Mar. 6, 1998

(86) PCT No.: PCT/SE98/00400

§ 371 Date: Dec. 16, 1999

§ 102(e) Date: Dec. 16, 1999

(87) PCT Pub. No.: WO98/40609

PCT Pub. Date: Sep. 17, 1998

(30) Foreign Application Priority Data

Mar. 11, 1997 (SE) ..... 9700863

(51) Int. Cl.[7] ..... F03C 4/00

(52) U.S. Cl. ..... 418/248; 418/240; 418/243; 418/250

(58) Field of Search ..... 418/248, 250, 418/243, 240

(56) References Cited

U.S. PATENT DOCUMENTS

| | | | | |
|---|---|---|---|---|
| 116,293 | * | 6/1871 | Freeman | 418/250 |
| 216,170 | * | 6/1879 | Fort | 418/250 |
| 1,172,505 | | 2/1916 | Cauwenbergh . | |
| 4,047,857 | | 9/1977 | Fischer . | |

FOREIGN PATENT DOCUMENTS

| | | | | |
|---|---|---|---|---|
| 2454059 | | 10/1975 | (DE) . | |
| 981475 | * | 5/1951 | (FR) | 418/248 |
| 1104871 | * | 5/1955 | (FR) | 418/248 |
| 1104871 | | 11/1955 | (FR) . | |
| 2252028 | * | 6/1975 | (FR) | 418/248 |
| 002004848 | * | 12/1993 | (RU) | 418/248 |
| 1605025 | * | 11/1990 | (SU) | 418/248 |

* cited by examiner

*Primary Examiner*—Thomas Denion
*Assistant Examiner*—Theresa Trieu
(74) *Attorney, Agent, or Firm*—Orum & Roth

(57) ABSTRACT

The present invention relates to a rotary piston engine to be used as a pump or an engine, comprising a housing (1) fitted with end walls (8, 9), a rotary body (2) rotatably mounted in said housing, and at least one sealing element (7) separating a volume formed between the housing (1) and the rotary body (2), said housing having at least one pair of inlet and outlet openings and the sealing element (7) having two legs portions, the ends of which abut against the rotary body (2), and a web portion intermediate said leg portions, said sealing element additionally being pivotable about a pivot axis on said web portion. The sealing element is movably associated with the housing in such a manner that the sealing element is displaceable radially, thus allowing the sum of the distances from the axis of rotation of the rotary body to the points of abutment on said body to vary.

3 Claims, 4 Drawing Sheets

ROTARY PISTON ENGINE

TECHNICAL FIELD

The present invention relates to a rotary piston engine to be used as a pump or an engine, comprising a rotor part mounted in a housing fitted with end walls and with at least one inlet and one outlet opening. Between each pair of inlet and outlet openings there is provided a sealing element separating the volume formed between the housing and the rotor part to prevent transport of medium between the inlet and outlet openings.

BACKGROUND

Owing to their simple construction and simple mode of operation, rotary piston engines theoretically may be used for a wide range of applications. The constructions used so far have been employed mainly for such hydraulic-technical applications where oil or other self-lubricating and non abrasive fluids are transported and the fluids are free of particles. The reason for this restricted use is that rotary piston engines, as presently designed, possess properties that discourage conveyance of abrasive materials through the engines since if they were, the wear would become too considerable, affecting engine reliability and performance.

The weakest point of these prior-art rotary piston engines is found in the movable partition wall that separates the suction and pressure sides (in pump applications) from one another. This partition wall usually is designed as a movable slide means that abuts against the rotary piston surface and by means of a force applied thereon is pressed in the direction towards the centre axis of the piston to provide a sealing action.

The pressure is applied by spring means, hydraulic means or in any other manner. The pressure requirements of the slide means depend on the pressure that has built up inside the engine and on the speed of rotation as well as on the configuration of the sealing surface (curve line) of the rotary piston.

In these rotary piston engines the slide means is carefully mounted in a groove/seat and moves with narrow tolerances in outwards and an inwards direction motion. The construction is sensitive to wear and other mechanical influences.

Another way of designing the partition wall is described in U.S. Pat. No. 1,172,505 wherein an oscillating yoke having two surfaces of contact that abut against a rotary piston forms the partition wall between the pressure and suction sides in a rotary piston engine that operates as a pump. The oscillating yoke and the rotary piston is configured to ensure that irrespective of the angle assumed by the rotor the yoke will abut against the rotor by means of two surface of contact. In addition, the yoke is mounted on a shaft that is attached to the pump housing in a fixed point of attachment about which point the yoke pivots.

A necessary prerequisite for this construction is that the sum of the distance from the centre of the rotary piston to one of the yoke tips and the distance from the centre of the rotary piston to the other yoke tip remains constant at all times. In practice, this means that the sealing force provided by the sealing yoke is directed diametrically against the rotor. A drawback of this design is the restriction that the above-mentioned condition imposes on the geometry of the rotary piston. Another disadvantage is that the sealing yoke is mounted on a shaft or similar means, which adds to the number of components that are exposed to wear and contribute to wedging of particles. A third disadvantage is that the yoke has large surface areas that are exposed to the medium on the pressure as well as one the suction sides, for which reason the output pressure acting on the rotary piston at the surfaces of abutment of the yoke increases rapidly at the counter-pressure rises and the negative pressure increases. Negative pressure on the suction side and excess pressure on the pressure side cooperate to increasing the pressure of abutment of the yoke on the pressure side. In addition, another consequence of this design is that a large proportion of the pump housing volume becomes inactive and does not take part in the pressure build-up by the rotary piston, in the fluid sealing, and so on.

Patent Specification U.S. Pat. No. 4,047,857 describes another constructional solution for sealing the rotary piston engine. This construction comprises at least one flexible curved membrane which is secured in a rotor rotating about a stator located interiorly thereof. The sealing membrane consists of a cylindrical stationary bearing portion which is fitted in the rotor to which the membrane is secured and around which the membrane oscillates in operation. The curved membrane abuts against the surface of the stator and is adapted to pivot into a curved recess in the rotor.

Quite apart from the technically complex manufacturing method, this construction, like the previous one, is formed with large pressure surfaces with resulting high pressure of abutment upon rising counter-pressures on the outlet side, and the negative pressure on the suction side co-operates with the excess pressure on the pressure side to further increase the pressure of abutment of the membrane against the surface of the stator during the rotation. In addition, the structure is extremely sensitive to the presence of particles that may easily wedge themselves in the gap formed between the upper face of the membrane and the recess in the rotor.

A feature common to all prior-art rotary piston engines operating on the principle of employing a sealing means in the shape of a yoke or a resilient membrane is that the yoke or the membrane pivots about a fixed centre line at a predetermined distance from the axis of rotation of the rotary piston or the rotary body.

OBJECT OF THE INVENTION

One object of the present invention is to enhance the usefulness of rotary piston engines in their capacity as all-purpose pumps that lend themselves to an extended range of applications, which is desirable considering the simple mode of operation of this type of engine, by removing the fundamental drawbacks and weaknesses inherent in the designs based on the above outlined structural principles, which is achieved by using a different technical structure for the partition wall that separates the pressure and suction sides of the pump from one another.

This object is achieved in a rotary piston engine of the kind defined in the appended claims.

SUMMARY OF THE INVENTION

The present invention is distinguished from prior-art rotary piston engines in that the rotary piston engine in accordance with the invention is fitted with a sealing element which is movably associated with the housing in such a manner that the sealing element is displaceable radially, thus allowing the sum of the distances from the axis of rotation of the rotary body to the points of abutment on said body to vary. Among other things, this arrangement makes the rotary piston engine flexible as regards the configuration of the rotary body, also with respect to wear thereon.

In accordance with another aspect of the invention the sealing element is displaceable also in and oppositely to the direction of rotation. This feature increases the flexibility and the simplicity of the structure further. More particularly, it becomes possible to make use of the forces exerted in the direction of rotation in order to transform these forces into radially exerted forces. This may be achieved for example by forming the intermediated web portion of the sealing element with surfaces that are inclined in the direction oppositely to the direction of rotation, which inclined surfaces are intended to engage portions of the housing in order to transform a force in the direction of rotation to a force in the radial direction. One advantageous embodiment of the rotary piston engine includes holders secured to the housing and projecting from the internal face thereof, said holders adapted to co-operate with V-shaped grooves formed in the web portion of the sealing elements in order to thus hold said elements in position.

In accordance with yet another aspect of the invention the holders are resiliently secured to the housing in order to be allowed radial displacement. In this manner the sealing element exerts its sealing effect also in the case of low engine speeds or when the engine is not in running.

Further advantages and characteristics of the construction in accordance with the invention will become apparent from the following description of preferred embodiments.

DESCRIPTION OF PREFERRED EMBODIMENTS

Embodiments of the invention will now be described in the following in more detail for exemplifying purposes and with reference to the accompanying drawings.

Figure 1:
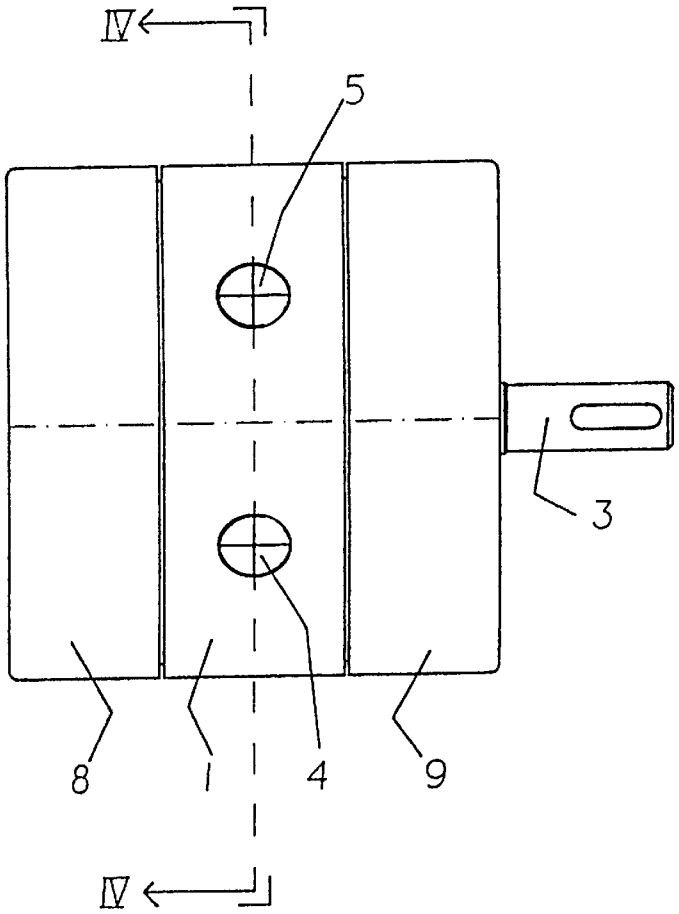
FIG. 1 is a plan view of one embodiment of a rotary piston engine in accordance with the invention.
Figure 2:
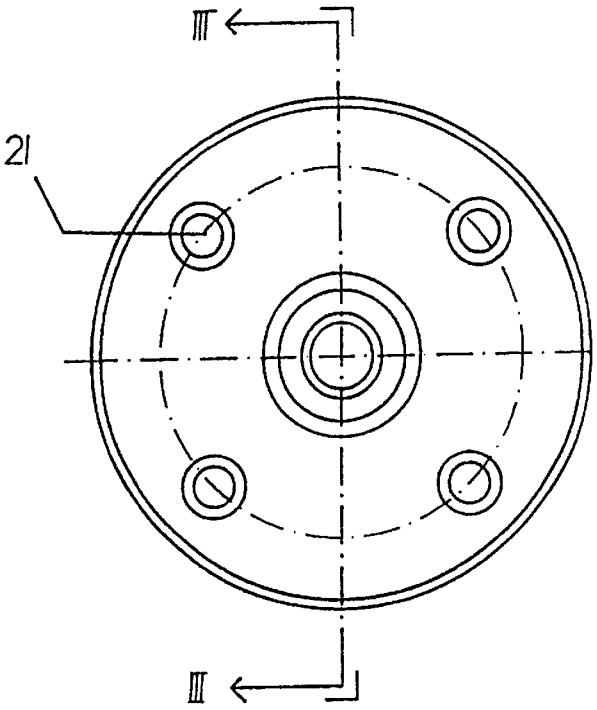
FIG. 2 is a lateral view of the engine of FIG. 1.
Figure 3:
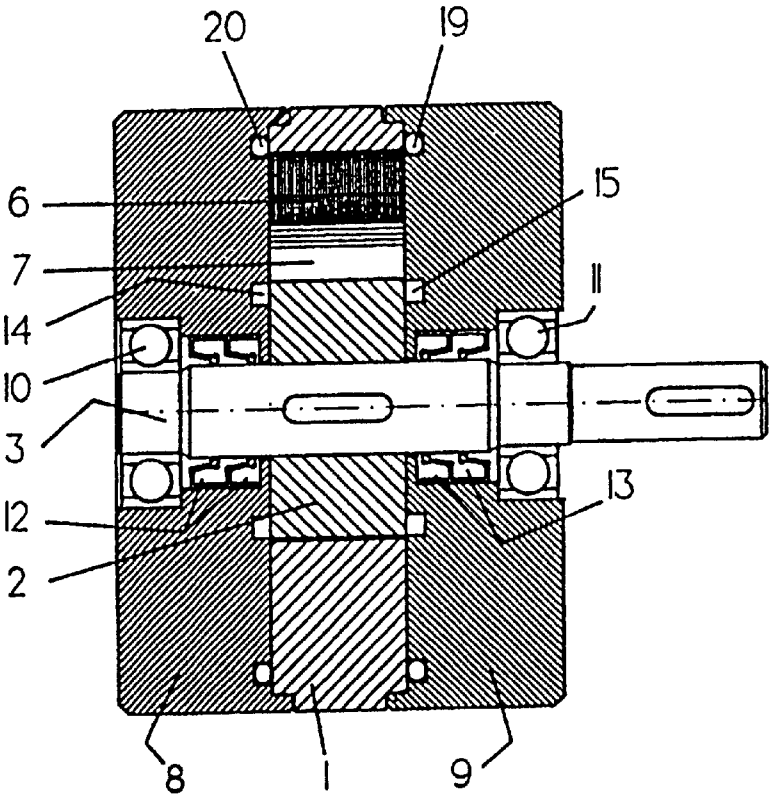
FIG. 3 is a longitudinal sectional view on line III—III of FIG. 2.

FIGS. 1–3 illustrate a rotary piston engine in accordance with a first embodiment of the invention. A housing 1 encloses a rotary body 2 mounted on a shaft 3. The housing 1 is provided with inlet and outlet openings 4 and 5. A sealing element 7 is located intermediate the inlet opening and the outlet opening and comes upon rotation of the rotary piston inside the space where sealing element movements are restricted by a holder 6, the rotary body 2 and two end walls 8 and 9 provided on the housing 1. The shaft 3 is supported in one or both end walls 8 and 9 by means of bearing members 10 and 11, and sealing elements 12 and 13, sealing in the axial direction, are located between the bearing members and the rotary body. Optionally, also sealing elements 14 and 15, sealing in the radial direction, may be provided in the end walls 8 and 9. The end walls and the housing are interconnected by means of screw joints 21, and sealing elements 19 and 20 are provided on both sides of the housing 1 in order to prevent leakage from the engine.

Figure 4:
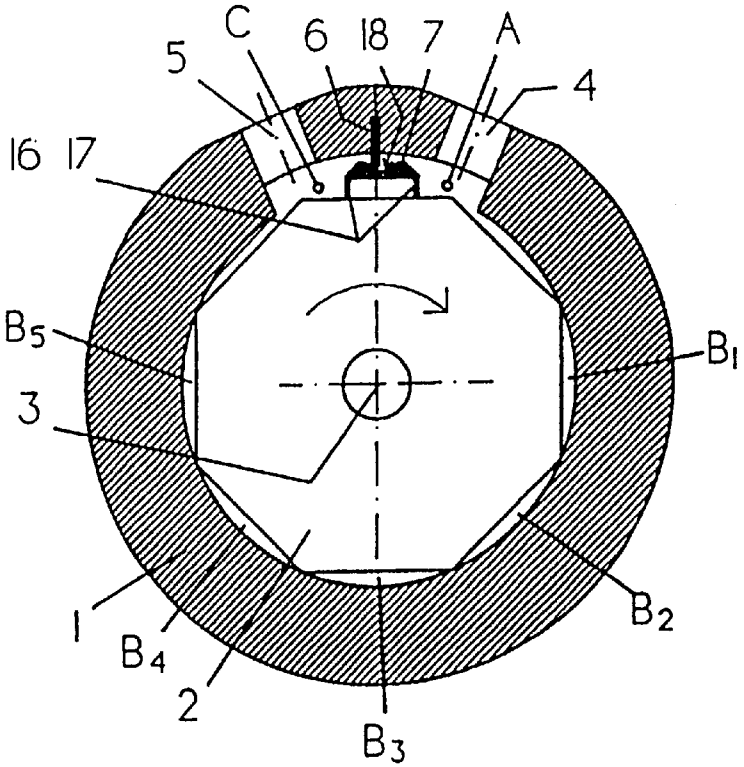
FIG. 4 is a cross-sectional view taken on line IV—IV of FIG. 1.

The sealing element 7 may be configured in several different ways but in accordance with one embodiment shown in FIG. 4, it is designed as a U-shaped means having two leg portions 16 and 17 in abutment against the rotary body 2 and presenting, on its face opposite the leg portions, a V-shaped groove 18 widening in the direction away from the two leg portions. The length of the sealing element is equal to that of the rotary body 2 and the element moves with a light-running fit between the housing end walls 8 and 9. The height of the sealing element is chosen to ensure stability of the element while in motion. The position of the V-shaped groove 18 relative to the two leg portions may be chosen at liberty but preferably the groove is positioned half-way between the leg portions. Should an especially low or high abutment pressure be required from the sealing element, the position of the V-shaped groove is changed in a direction towards or away from, respectively, the leg portion closest to the outlet opening of the engine, in the case when the latter functions as a pump, and in the opposite direction for engine functions.

The housing 1 is formed with a recess from which the inlet and outlet openings depart. The holder 6 is placed intermediate the openings and serves to delimit and to guide the movements of the sealing element 7 in the rotational plane (co-ordinate directions x and y, the movement in the direction of the z-co-ordinate being restricted by the end walls 8 and 9) during the progress of the rotational movement. Preferably, the holder 6 is formed with an angled tip of lesser angle that the open V-shaped groove 18 formed in the sealing element, the tip being shaped to ensure that the sealing element may pivot freely inside the groove during the rotation of the rotary piston.

The rotor 2 is formed by a rotary body which is centrally located inside the housing 1, being supported therein in bearing means in at least one of the end wall plates 8 and 9. The cross section of the rotary body preferably is uniform along the entire length of the body and it should contain at least one line where the diameter essentially equals the diameter of the housing 1, whereby, upon rotation, at least two chambers are defined between the rotor 2, the housing 1 and the sealing element(s) 7. In accordance with the embodiment illustrated in the drawing figures, the rotary body is shown as a regular polygon, manufactured from a cylinder from which material has been milled away to form the faces of the polygon, FIG. 4 shows a rotary body having eight equal sides.

During the rotation of a polygon body the sum of the distances from two arbitrarily chosen points of contact of the leg portions 16 and 17 at the periphery of the body is not constant but the sum of the distance values changes depending on the angular position of the body. For this reason it is necessary that a sealing element which is to seal against a rotary body of this kind be able to move in the plane of rotation during the rotation while at the same time being able to perform its sealing action to ensure that a counter-pressure is maintained.

The engine in accordance with the invention operates in the following manner. During the rotation of the rotary body 2 in the direction indicated by an arrow opening 4 is the inlet opening and opening 5 the outlet opening when the engine operates as a pump. Fluid enters through opening 4 and fills the inlet chamber A defined between means 1, 2, 6, 7, 8, and 9. Upon its rotation, the rotary piston carries along fluid present in the spaces $B_1$–$B_5$ defined between the flat sides of the rotary piston and the wall of the pump housing, thus causing a negative pressure to generate in A and more fluid to be sucked in through the opening 4. The fluid is carried to the outlet chamber C. The means 6 and 7 block the transport between A and C, the fluid thus being forced to exit through the outlet opening 5. During the rotation, means 7 takes part in the movements of the rotary piston, said movements being controlled by the two-face abutment of the leg portions 16 and 17 against the rotor and by a force urging the means 7 against the rotor. This force consists of the radially directed component of the total force that is being built up by the pressure of the fluid in the outer chamber, the negative pressure in the inlet chamber and the friction arising between means 7 and the rotor 2 during the rotation and that is transferred through a wedging effect as the means 7 abuts against the holder 6.

Figure 5:
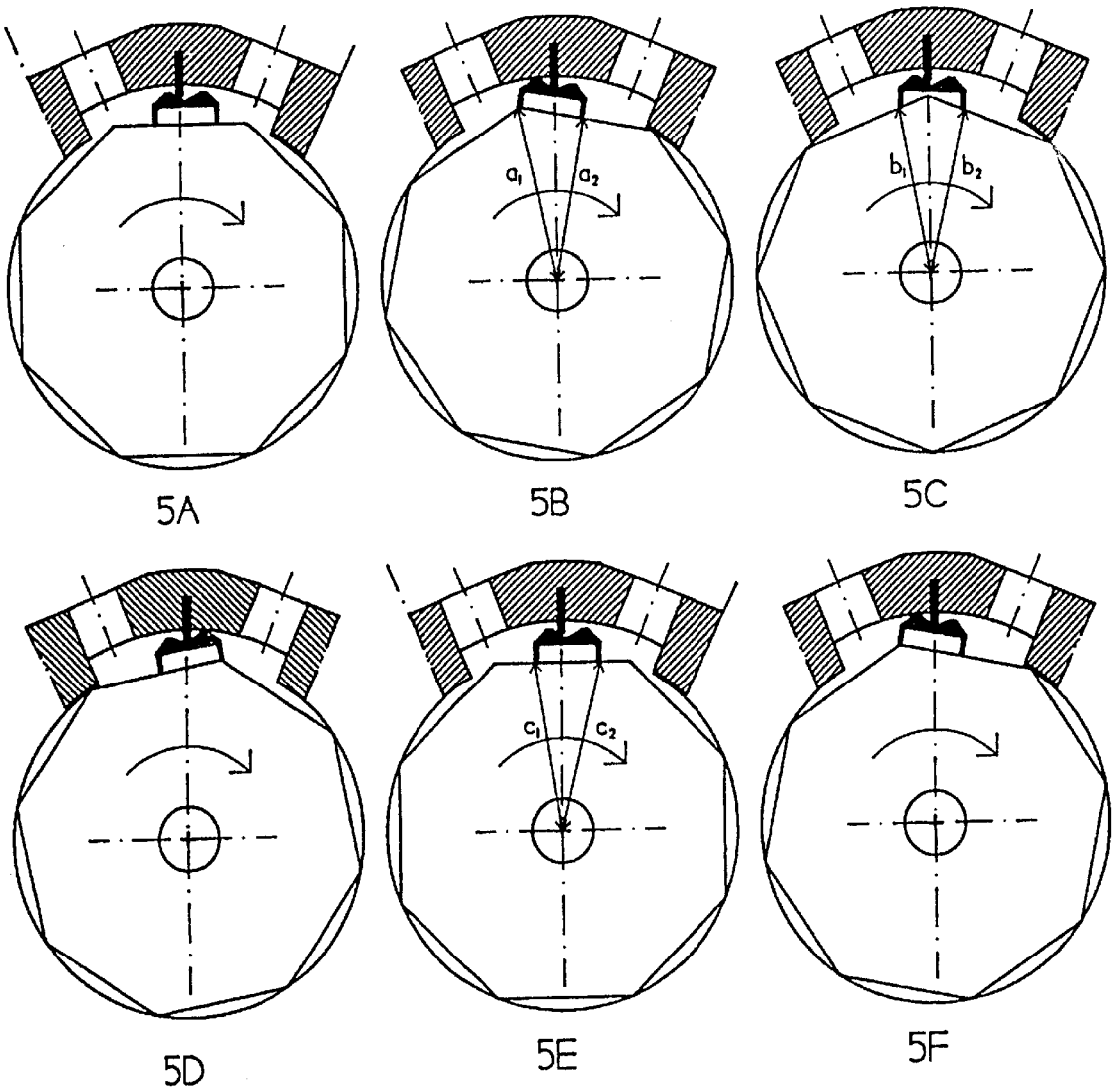
FIGS. 5A–5F are views showing the changes of position of the sealing element upon rotation of the rotary piston of the embodiment of the engine illustrated in FIGS. 1–4.

FIG. 5 illustrates the manner of movement of the sealing element during the rotation, FIGS. 5A–F showing sequentially the rotation of the rotor 2. FIG. 5B shows the position of the means 7 relative to the rotor 2 when the sum of the distances a1+a2 from the leg portions to the centre of the rotor axis is at its maximum. In this position the sealing element 7 is furthest away from the centre of the axis of rotation 3 and consequently, in this position, the tip of the holder 6 assumes its lowermost position inside the groove 18 of the sealing element.

Upon continued rotation of the pivot shaft/axis of rotation the position illustrated in FIG. 5C is reached, in which position the distances from the leg portions 16 and 17 to the axis centre are b1 and b2, respectively. The sum of b1 and b2 is smaller than the sum of a1 and a2, and consequently the means 7 is closer to the centre of rotation of the rotary piston, with the result that the tip of the holder 6 now is further away from the bottom of the groove 18 and that in addition the point of engagement between means 6 and 7 is displaced further away from the centre line of groove 18 than is the case in FIG. 5B.

Upon further rotation of the rotary body to the position illustrated in FIG. 5E, the means 7, in accordance with the shown embodiment, has reached its position closest to the centre axis, i.e. the sum of distances c1 and c2 from the axis centre to the leg portions 16 and 17 is smaller than the sum a1+a2 and b1+b2, respectively. In this case, means 7 has moved closer to the centre of the axis of rotation and therefore the distance from the bottom of the V-shaped groove 18 to the tip of the holder 6 is at its maximum, with the added consequence that also the displacement between the point of engagement of means 6 and 7 relative to the centre line of the V-shaped groove 18 is at its maximum.

Upon further rotation of the rotary piston, means 7 is returned to its maximum position, i.e. the tip of the holder 6 is carried downwards inside the groove 18 and the means 7 increases its distance from the axis of rotation.

The principle of sealing-element movements is applicable to all types of geometrical profile configurations that may be used for the rotary piston.

It is essential for the function of the rotary piston engine in accordance with the invention that the position of the sealing element is constantly defined by the rotary piston acting on the leg portions of that element and that a radial force acts on the sealing element during operation to ensure abutment of the leg portions against the rotary body. To achieve this, a pivotal movement about an axis of rotation on the sealing element is required, and this axis of rotation migrates on the sealing element when arbitrary rotary bodies are used and when the element at the axis of rotation pivots against a fixed back-up means 6. In consequence of the migration of the axis of rotation, during the rotation, the sealing element will be displaced forward and backwards in parallel with the housing, i.e. in or oppositely to the direction of rotation, and therefore it will be displaced also radially, i.e. the distance from the axis of rotation to the plane containing the points of abutment is allowed to vary.

A rotary piston engine conceived in this manner possesses several advantages compared with already known constructions, among them that:

1. The construction affords considerable freedom of choice and flexibility as regards the design of the geometrical configuration of the rotor.
2. The sealing element is self-adjusting for adaptation to the gradual wear on the rotor and the sealing element.
3. The construction makes possible a simple structure of the rotary piston engine.
4. Only a limited part of the pump housing is used for accommodating the sealing element compared with the principles on which are based the constructions including a yoke the sealing action of which is exerted against two diametrically opposite points on the rotary piston. The embodiment according to which the engine is used as a pump offers considerable advantages, since an extremely high suction capacity is obtained as a result of the existence of several sealing surfaces between sectors B1–B5. The principle of construction on which the invention is based also allows several inlet and outlet openings to be provided around the periphery of the housing, with resulting considerable increase of capacity while at the same time a practically constant flow may be obtained.
5. Because the sealing element pivots constantly while moving radially and along the periphery of the rotor, the joint becomes self-cleansing.
6. The engine may run under no-load conditions for a prolonged period of time without there being any risk that detrimental frictional heat generates between the sealing element and the rotor since when no load is on the engine no fluid pressure builds up on the pressure or suction side and consequently the pressure of abutment between the sealing element and the rotary piston is close to zero. In practice, this is of utmost importance as it minimizes risks of engine breakdown during dry engine running conditions.
7. The construction offers large freedom of choice of materials for different applications of the engine and to achieve special operational technical advantages from the rotary piston engine. For example, the pump may be manufactured from PE and PP plastics when used in the chemico-technical industry. Another example is to choose a rotary piston of acetal plastics and a sealing element made from stainless steel, or vice versa, thus further enhancing the excellent properties during the dry engine running conditions referred to in point 6 above.
8. The sealing element may be modified to satisfy particular needs; for example a return flow may be made to pass through the element to provide pressure relief and lubrication.

It is of course possible to use several pairs of respectively inlet and outlet openings in one and the same rotary piston engine, with sealing elements being positioned intermediate the openings, in order to increase the engine performance.

Figure 6:
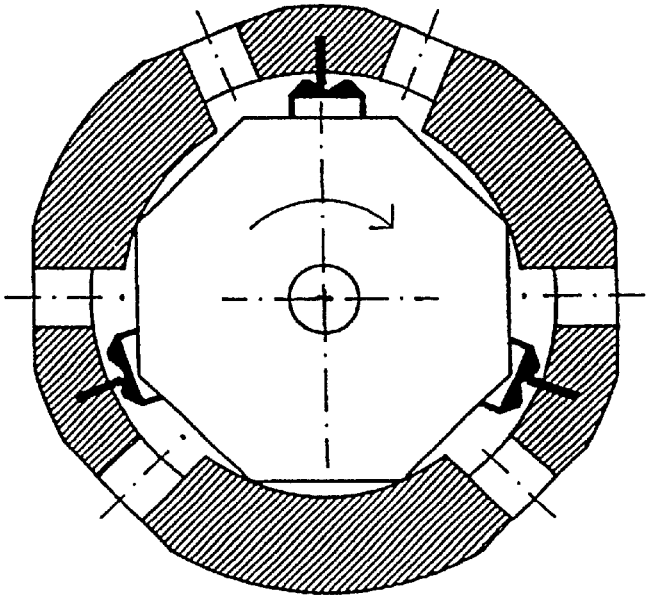
FIG. 6 shows an embodiment of the engine having several inlet and outlet openings formed in a pump housing, and several sealing elements.

For example, in FIG. 6 is shown one modified embodiment using three sealing elements.

Figure 7A:
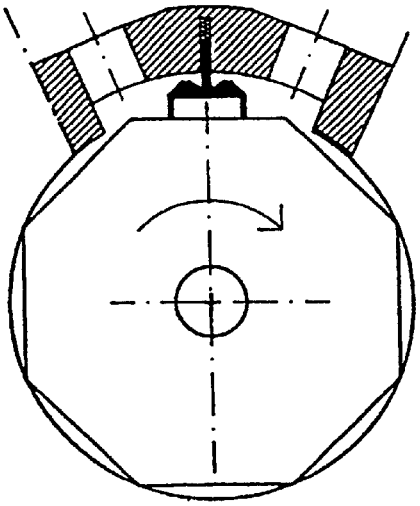
FIGS. 7A and 7B show alternative embodiments of sealing elements and fastener arrangements.

FIG. 7A illustrates yet another embodiment wherein the radial movement, i.e. the distance from the sealing element pivot axis to the rotary body centre axis, is adjusted by a spring-loaded displaceable holder. Optionally, the sealing element pivot axis may in this case be fixed relative to the securement means. In accordance with this embodiment of the sealing element and the holder, the sealing element 7 abuts against the rotary piston also when no pressure differential exists between the inlet and outlet chambers A and C, because the holder is exposed to spring action and in consequence thereof urges the sealing element radially downwards, against the rotor 2.

Figure 7B:
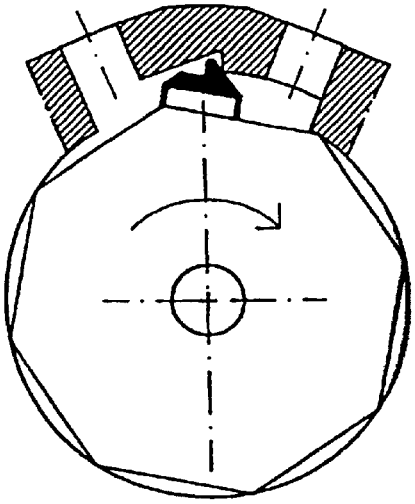

FIG. 7B illustrates a further alternative embodiment of the sealing element. In accordance with this version there is no separate holder. Instead, an upwardly protruding member including downwardly sloping faces is formed on the web portion intermediate the two leg portions of the sealing element. These sloping faces are adapted to cooperate with edges formed in a recess in the internal wall of the housing. In this manner a wedging effect similar to that found in the initially described embodiment of the invention is obtained, for transforming a force acting in the direction of rotation to a force acting in the radial direction.

It goes without saying that further modifications of the invention are possible. Such obvious modifications must be considered to be within the scope of protection of the invention as the latter is defined in the appended claims.

What is claimed is:

1. A rotary piston engine to be used as a pump or a engine, comprising:

a housing fitted with end walls;

a rotary body rotatably mounted in said housing; and at least one sealing element separating a volume formed between the housing and the rotary body, said housing having at least one pair of inlet and outlet openings and the sealing element having two leg portions, the ends of which abut against the rotary body, and a web portion intermediate said leg portions, said sealing element additionally being pivotable about a pivot axis on said web portion, wherein said sealing element is movably associated with the housing in such a manner that the sealing element is displaceable radially, thus allowing the sum of the distances from the axis of rotation of the rotary body to the points of abutment on said body to vary, said sealing element is also displaceable in and oppositely to the direction of rotation, and the intermediate web portion of the sealing element is formed with surfaces that are inclined in the direction oppositely to the direction of rotation, which inclined surfaces are intended to engage portions of the housing in order to transform a force in the direction of rotation to a force in the radial direction.

2. A rotary piston engine as claimed in claim 1, further comprising holders secured to the housing and projecting from the internal face thereof, said holders adapted to co-operate with V-shaped grooves formed in the web portion of the sealing elements in order to thus hold said elements in position.

3. A rotary engine piston as claimed in claim 2, wherein said holders are resiliently secured to the housing in order to be allowed radial displacement.

* * * * *